11/8/83 OR 4,414,652

United States Patent [19]

Crist

[11] 4,414,652

[45] Nov. 8, 1983

[54] ULTRASONIC LINE SENSOR

[75] Inventor: Scott D. Crist, Minnetonka, Minn.

[73] Assignee: Honeywell, Inc., Minneapolis, Minn.

[21] Appl. No.: 277,757

[22] Filed: Jun. 26, 1981

[51] Int. Cl.[3] ..... G08B 13/22

[52] U.S. Cl. ..... 367/93; 340/566; 340/665

[58] Field of Search ..... 367/93, 136, 169; 340/552, 561, 564, 565, 566, 665, 668; 333/193, 194, 220, 221, 240, 241; 73/584, 594, 658

[56] References Cited

U.S. PATENT DOCUMENTS

| | | | |
|---|---|---|---|
| 2,649,579 | 8/1953 | Alexander | 367/169 X |
| 2,721,994 | 10/1955 | Brown | 340/561 |
| 3,438,021 | 4/1969 | Nelkin et al. | 340/566 |
| 4,004,268 | 1/1977 | Cook | 340/17 R |
| 4,023,156 | 5/1977 | Galvin | 340/274 R |
| 4,107,660 | 8/1978 | Chleboun | 340/566 |
| 4,112,420 | 9/1978 | Mifune | 340/555 |
| 4,286,261 | 8/1981 | Wagner et al. | 367/136 X |
| 4,300,135 | 11/1981 | Korn et al. | 73/594 X |

*Primary Examiner*—Glen R. Swann, III
*Attorney, Agent, or Firm*—George W. Field

[57] ABSTRACT

An ultrasonic line sensor including an elongated transmission line for longitudinal pressure waves, which changes transmission characteristics with change in the length of the line due to transverse mechanical loading, and also including apparatus for energizing the line with longitudinal pressure waves at a long term frequency which establishes a standing wave in the line, and for responding to short-term changes in the natural frequency of the line.

3 Claims, 2 Drawing Figures

ULTRASONIC LINE SENSOR

TECHNICAL FIELD

This invention relates to the field of security and particularly to border security apparatus for detecting the presence of intruders crossing the boundary of an area to be secured.

BACKGROUND OF THE INVENTION

It is often necessary to protect an area against intrusion by giving an alarm when an intruder approaches the area, and it is preferred that the protection arrangement be not noticeable to the intruder, and hence less subject to being avoided.

Buried line sensors have been proposed for use when the area to be protected is out of doors. They have operated on various magnetic, electrical, and optical principles, and have utilized costly, fragile, and complex transducers easily damaged by careless handling or adverse elements.

SUMMARY OF THE INVENTION

The present invention uses a simple metallic wire which serves as an accoustic transmission line. It is a mechanical transducer along its entire active length, and is not dependent on any electrical, magnetic, or optical properties of the wire. A transducer is coupled to one end of the line for energizing it with longitudinal pressure waves and for detecting changes in the load presented to the line resulting from minute changes in line length due to transverse loading.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals indicate corresponding parts throughout the several views.

DESCRIPTION OF THE PREFERRED EMBODIMENT

Figure 1:
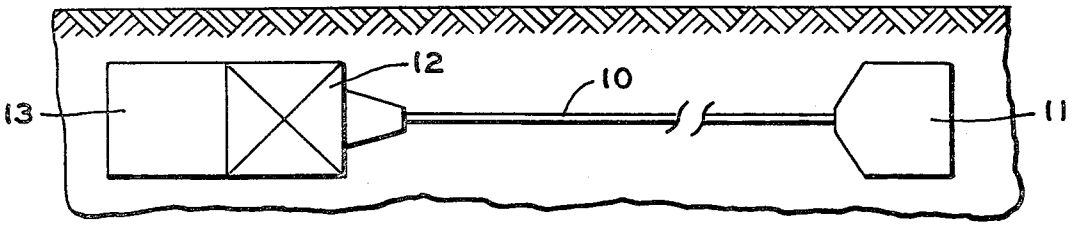
FIG. 1 shows the invention in use for border security.

An ultrasonic line sensor according to the invention is shown schematically in FIG. 1 to comprise a transmission line 10 in the form of a simple metallic wire extending from a terminating mass 11 at one end to a transducer assembly 12 and terminating mass 13 at the other end. The entire sensor may be buried in the ground, at a depth determined by the expected mass distribution of any intruder to be detected (6 to 18 inches typically).

Figure 2:
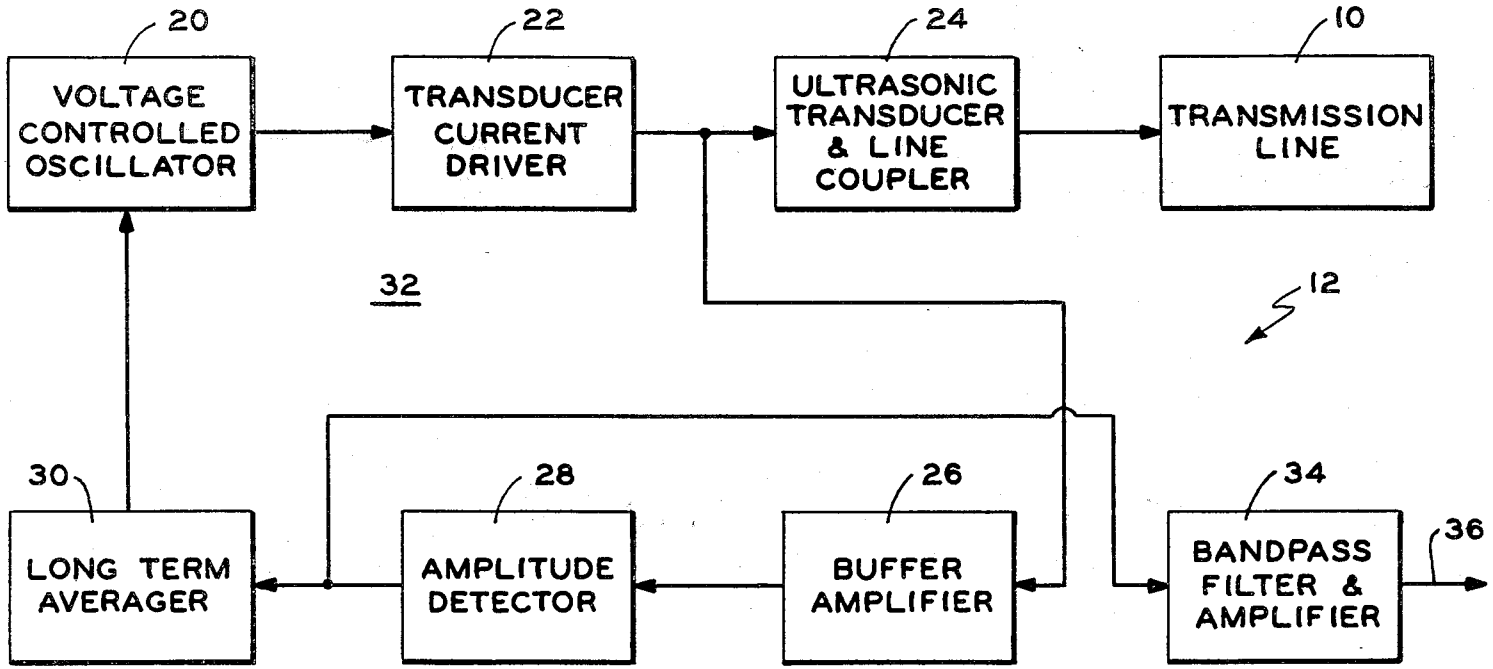
FIG. 2 is a block diagram for a transducer assembly for energizing the transmission line of FIG. 1.

FIG. 2 shows transducer assembly 12 in block diagram with suitable excitation/detection electronics. A voltage controlled oscillator 20 energizes a driver 22 for an ultrasonic transducer and line coupler 24 to which resonant line 10 is connected. The driver output is also supplied through a buffer amplifier 26 to an amplitude detector 28, which acts through a long term averager 30 to supply frequency control voltage to oscillator 20: elements 20–30 comprise a slow acting automatic frequency control loop 32. The amplitude detector output is also supplied through a band pass filter and amplifier 34 to provide the output 36 of the assembly.

OPERATION

Line 10 terminating in masses 11 and 12 has natural frequency for longitudinal pressure waves and their harmonics which is determined by the length and tension of the wire. At ultrasonic frequencies the wire is many wavelengths long, and the oscillator frequency is adjusted to one of the normal longitudinal modes of vibration with standing waves then being established in the wire.

If oscillator 20 is set at a resonant frequency of the line, a minimum load is applied to the current driver. Note that the energy in question is that of longitudinal mechanical vibration in the line.

Now any load applied to the soil surface above a section of the buried line causes a soil displacement, and consequent change in tension loading along the length of the line: since the entire line is captive in the soil, this gives rise to a localized change in the length of the line and the frequency of oscillator 20 is no longer a harmonic of the natural frequency of the line. The load on driver 22 offered by transducer 24 accordingly increases changing the output to amplifier 26 and detector 28. The output of detector 28 changes in magnitude, and the change is transmitted to filter 34 and appears at output 36 to operate a suitable alarm or indicator.

If the load is momentary, as by the passage of a vehicle or the tread of a foot, averager 30 prevents change in oscillator 20 in so short an interval, and when the load is removed the system remains as before. Slower or more sustained changes in line length, due for example to change in temperature or overall soil settling, act to change the frequency of oscillator 20 to a harmonic of the new line length, and such slow changes are not passed by filter 34 to give an alarm output.

It is to be remembered that the magnitude of the length change is to be compared with the wavelength of the longitudinal vibration, rather than being compared with the overall length of the line. At ultrasonic frequencies, wavelengths in the range from 1 inch to 5 inches are representative, so that a change in line length of micro-inches results in a very considerable signal. Typical output sensitivity can be expected in the parts-per-million range, which is available in other buried line sensor systems.

From the above it will be evident that the invention comprises a buried line sensor using longitudinal pressure waves in a metallic line which is impervious to abusive handling and adverse environments, and which has a sensitivity comparable to other more delicate or intricate systems.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

I claim:

1. A line sensor comprising, in combination:

an elongated transmission line for longitudinal pressure waves which change transmission characteristics with change in the length of said line due to transverse mechanical loading;

means for energizing said line with longitudinal pressure waves at a desired frequency of operation, including means for maintaining said frequency of operation at a long-term value;

and means responsive to short term changes in said frequency of operation.

2. An ultrasonic line sensor comprising, in combination:

an elongated transmission line having a natural frequency, for longitudinal pressure waves, which changes with change in the length of said line due to transverse mechanical loading;

means for energizing said line with longitudinal pressure waves of ultrasonic frequency, including means for maintaining the frequency of said waves at a long-term value which establishes standing waves in said line;

and means responsive to short-term changes in the load on the line energizing means resulting from short-term changes in said natural frequency.

3. Apparatus according to claim 1 in which said means for energizing said line is at one end of said line and a termination mass is at the other end of said line.

* * * * *